US005141566A

United States Patent [19]

Kitayama et al.

[11] Patent Number: 5,141,566

[45] Date of Patent: Aug. 25, 1992

[54] PROCESS FOR MANUFACTURING CORROSION-RESISTANT SEAMLESS TITANIUM ALLOY TUBES AND PIPES

[75] Inventors: Shiroh Kitayama, Kobe; Yoshiaki Shida, Ikoma, both of Japan

[73] Assignee: Sumitomo Metal Industries, Ltd., Osaka, Japan

[21] Appl. No.: 708,719

[22] Filed: May 31, 1991

[30] Foreign Application Priority Data

May 31, 1990 [JP] Japan ..... 1-144099

[51] Int. Cl.[5] ..... C22F 1/00; C22C 14/00

[52] U.S. Cl. ..... 148/670; 148/421; 420/417

[58] Field of Search ..... 148/11.5 F, 133, 421; 420/417

[56] References Cited

U.S. PATENT DOCUMENTS

| | | | |
|---|---|---|---|
| 3,492,172 | 1/1972 | Sauvageot et al. | 148/11.5 F |
| 3,635,068 | 1/1972 | Watmough et al. | 148/11.5 F |
| 3,649,374 | 3/1972 | Chalk | 148/11.5 F |
| 3,969,155 | 7/1976 | McKeighen | 148/11.5 F |
| 4,854,977 | 8/1989 | Alheritiere et al. | 420/417 |
| 4,859,415 | 8/1989 | Shida et al. | 420/417 |
| 5,026,520 | 6/1991 | Bhowal et al. | 148/11.5 F |

FOREIGN PATENT DOCUMENTS

| | | |
|---|---|---|
| 62-107041 | 5/1987 | Japan . |
| 62-149836 | 7/1987 | Japan . |
| 64-11006 | 1/1989 | Japan . |
| 64-21040 | 1/1989 | Japan . |
| 64-21041 | 1/1989 | Japan . |

OTHER PUBLICATIONS

Bashanov et al., "Manufactureof Titanium Tubes on Helical Rolling Mills", *Titanium Alloys-Scientific and Technology Aspects*, vol. 1, pp. 313-320 (May 1976).

*Primary Examiner*—Upendra Roy

*Attorney, Agent, or Firm*—Burns, Doane, Swecker & Mathis

[57] ABSTRACT

A process for manufacturing seamless titanium alloy tubes or pipes having good corrosion resistance and good mechanical properties from a titanium alloy which consists essentially, by weight, of one or more of the platinum group metals in a total amount of 0.01-0.14%, at least one of Ni and Co each in an amount of 0.1%-2.0%, no more than 0.35% of oxygen, not more than 0.30% of iron, optionally at least one of Mo, W, and V each in an amount of 0.1%-2.0%, and a balance of Ti. The process comprises preparing a billet by hot working after preheating in a temperature range of from 650° C. to a temperature 100° C. above the beta-transus point and subjecting the billet to tube extrusion after preheating in a temperature range of from 650° C. to a temperature 100° C. above the beta-transus point, optionally followed by at least one of annealing, cold drawing, and cold or warm rolling.

18 Claims, 1 Drawing Sheet

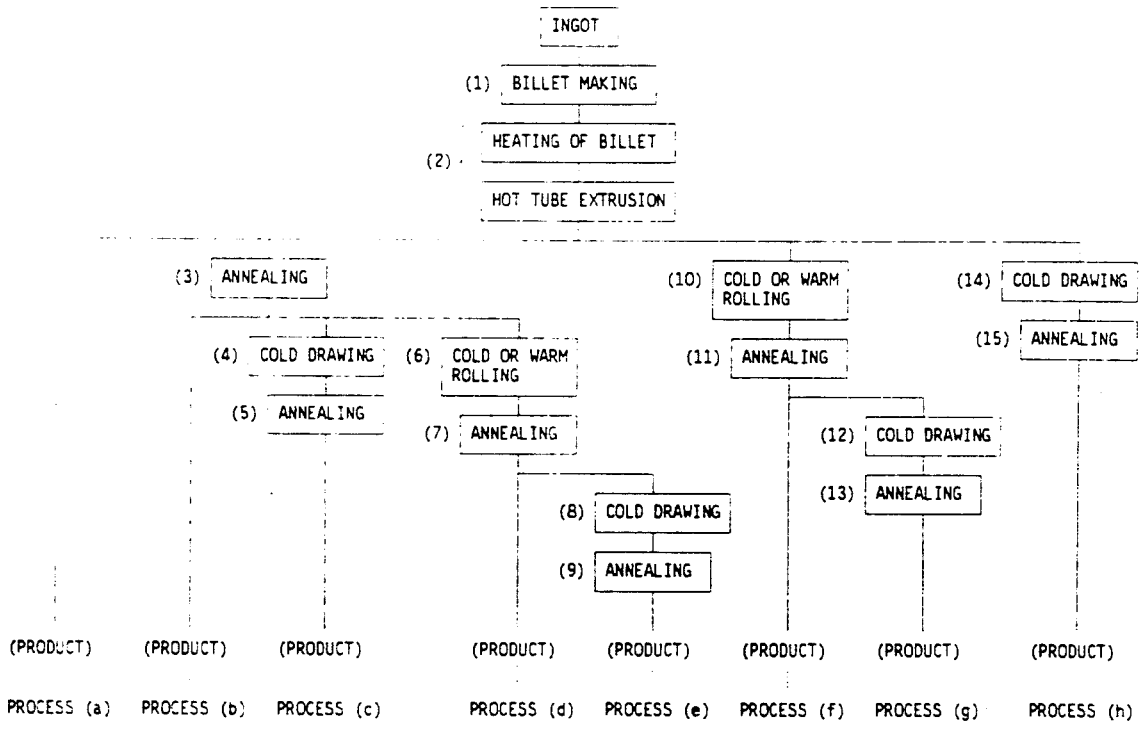

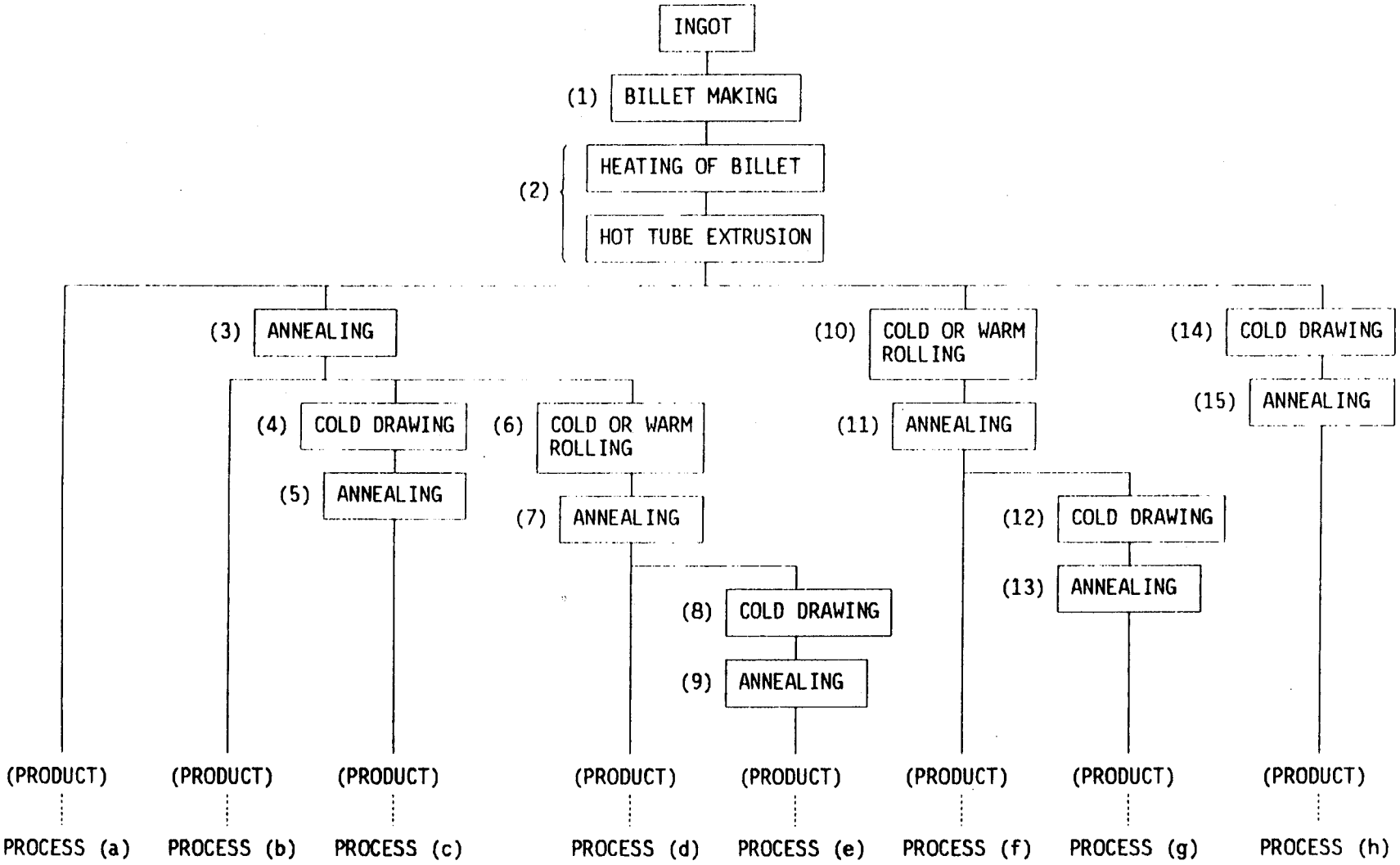
INGOT
(1)
BILLET MAKING
(2)
HEATING OF BILLET
HOT TUBE EXTRUSION
(3)
ANNEALING
(4)
COLD DRAWING
(5)
ANNEALING
(6)
COLD OR WARM ROLLING
(7)
ANNEALING
(8)
COLD DRAWING
(9)
ANNEALING
(10)
COLD OR WARM ROLLING
(11)
ANNEALING
(12)
COLD DRAWING
(13)
ANNEALING
(14)
COLD DRAWING
(15)
ANNEALING
(PRODUCT)
PROCESS (a)
(PRODUCT)
PROCESS (b)
(PRODUCT)
PROCESS (c)
(PRODUCT)
PROCESS (d)
(PRODUCT)
PROCESS (e)
(PRODUCT)
PROCESS (f)
(PRODUCT)
PROCESS (g)
(PRODUCT)
PROCESS (h)

PROCESS FOR MANUFACTURING CORROSION-RESISTANT SEAMLESS TITANIUM ALLOY TUBES AND PIPES

BACKGROUND OF THE INVENTION

This invention relates to a process for manufacturing seamless tubes and pipes (hereinafter collectively referred to as "seamless tubes") from an inexpensive titanium alloy having improved resistance to crevice corrosion and to acids. More particularly, it relates to a process for manufacturing seamless titanium alloy tubes having improved corrosion resistance in environments inducing severe crevice corrosion or in non-oxidizing acids, which pure titanium metal cannot withstand.

Titanium has good corrosion resistance in sea water and in oxidizing acids such as nitric acid and it is widely used as a material for condensers in nuclear power stations and heat-exchanger tubes in chemical plants. However, its resistance to crevice corrosion is poor in high-temperature corrosive environments containing chloride ions. Therefore, titanium alloys containing 0.12%-0.25% by weight of palladium (Ti-0.12/0.25Pd) as specified in ASTM grade 7 or 11 (or JIS Classes 11 to 13) are recommended for use in such environments. The use of these alloys which contain expensive Pd metal in a relatively large amount is limited due to their high costs.

An attempt has been made to develop a more economical titanium alloy having resistance to crevice corrosion. Japanese Unexamined Patent Application Kokai Nos. 62-107041(1987), 62-149836(1987), 64-21040(1989), and 64-21041(1989) disclose corrosion-resistant titanium alloys which contain a relatively small amount of one or more of the platinum group metals, one or two of Ni and Co, and optionally one or more of Mo, W, and V.

In order to apply these titanium alloys to actual products, a commercial manufacturing process of the products should be established so as to make it possible to manufacture products having optimum properties efficiently. This is important since the properties of titanium and titanium alloys significantly vary depending on the manufacturing process and conditions.

Particularly in the manufacture of seamless tubes, such as for use in heat exchangers, it is impossible to provide a product having good mechanical properties and corrosion resistance unless all the steps from billet making to final heat treatment are performed under properly controlled conditions. However, since fabrication of titanium alloys into sheets and welded tubes is primarily performed under cold conditions, the optimal conditions for the manufacture of seamless titanium alloy tubes have not been investigated sufficiently in the past. Thus, there is a need to establish a process and conditions for commercially manufacturing corrosion-resistant seamless titanium alloy tubes of good quality.

SUMMARY OF THE INVENTION

It is an object of the present invention to provide a process for manufacturing seamless tubes of good quality from an inexpensive titanium alloy having a relatively low content of the platinum group metals.

Another object of the invention is to provide a process for manufacturing seamless titanium alloy tubes which have improved resistance to corrosion, particularly to crevice corrosion and which can be satisfactorily used as brine heaters in a seawater desalination plant and as heat-exchanger tubes exposed to concentrated brine, such as those in a salt manufacturing plant, or exposed to a sulfur dioxide-containing wet environment.

These objects can be accomplished by manufacturing seamless tubes from an inexpensive, versatile titanium alloy having good resistance to crevice corrosion and high deformability.

The present invention provides a process for manufacturing seamless titanium alloy tubes having good resistance to crevice corrosion from a titanium alloy which consists essentially, on a weight basis, of one or more of the platinum group metals in a total amount of 0.01-0.14%, at least one of Ni and Co each in an amount of 0.1%-2.0%, not more than 0.35% of oxygen, not more than 0.30% of iron, optionally at least one of Mo, W, and V each in an amount of 0.1%-2.0%, and a balance of Ti, the process comprising the steps of:

preparing a billet by hot working from an ingot of the titanium alloy after the ingot has been heated in a temperature range of from 650° C. to a temperature 100° C. above the beta-transus point;

subjecting the billet to tube extrusion using a glass lubricant to form a seamless tube after the billet has been heated in a temperature range of from 650° C. to a temperature 100° C. above the beta-transus point, and optionally performing one or more of the following steps on the resulting seamless tube:

(i) annealing the tube in a temperature range of 500° C.-850° C., (ii) subjecting the tube to drawing under cold conditions followed by annealing in a temperature range of 500° C.-850° C.; and (iii) subjecting the tube to rolling under cold or warm conditions followed by annealing in a temperature range of 500° C.-850° C.

BRIEF DESCRIPTION OF THE DRAWING

The sole figure is a flow diagram of the process of the present invention.

DESCRIPTION OF THE INVENTION

A first feature of the present invention is the use of a starting material of a titanium alloy which contains a relatively small amount of at least one of the platinum group metals, Ni and/or Co, and optionally one or more other alloying elements.

A second feature of the invention is the determination of optimal conditions for each step involved in the manufacture of seamless tubes from the above-described titanium alloy, particularly billet making, hot tube extrusion, cold or warm rolling, cold drawing, and heat treatment and subjecting the starting material to various combinations of these steps as shown in the figure, thereby manufacturing corrosion resistant seamless tubes of good quality without a significant loss of the excellent chemical and mechanical properties of the material.

In the following description, all percent refers to percent by weight unless otherwise indicated.

The titanium alloy used as a starting material in the process of the present invention consists essentially of one or more of the platinum group metals (Ru, Rh, Pd, Os, Ir, and Pt) in a total amount of from 0.01% to 0.14%, at least one of Ni and Co each in an amount of from 0.1% to 2.0%, not more than 0.35% of oxygen, not more than 0.30% of iron, optionally at least one of Mo, W, and V each in an amount of from 0.1% to 2.0%, and a balance of Ti. Such an alloy composition is selected for the following reasons.

(i) Platinum Group Metals (Ru, Rh, Pd, Os, Ir, and Pt)

The addition of at least one of the platinum group metals as an alloying element is effective to improve the corrosion resistance of a titanium alloy including its resistance to crevice corrosion and its resistance to acids. Among these elements, Pd and Ru are preferred since they are less expensive and more effective for improving the corrosion resistance than the other platinum group elements. When added to titanium as an alloying element, the effect of Pd on improvement in crevice corrosion resistance is greater than that of a comparable amount in percent of Ru, so Pd is more preferable. The improvement in corrosion resistance is appreciable when the total amount of the platinum group metals is 0.01% or more, and the improvement becomes more significant as the content increases. However, in the presence of Ni and/or Co as a co-alloying element, the effect of the platinum group metals tends to saturate when the total amount thereof exceeds 0.14%. In addition, the incorporation of such a large amount of the platinum group metals greatly increases the material cost and promotes hydrogen absorption by the alloy. Therefore, the total amount of the platinum group metals is in the range of 0.01%-0.14% and preferably 0.03%-0.10%.

(ii) Cobalt (Co) and Nickel (Ni)

Co and Ni serve to strengthen the passivated film formed on the surface of titanium, which is necessary for titanium to have corrosion resistance. More specifically, these elements are precipitated as $Ti_2Co$ and $Ti_2Ni$, respectively, which lower the hydrogen overpotential, thereby serving to maintain and strengthen the passive state of titanium. Furthermore, the presence of these precipitates in the passivated film has the effect of decreasing the current density required to maintain the passive state. When Co or Ni is added to titanium along with the platinum group metals, it has a significant effect of strengthening and stabilizing the passivated film of titanium, particularly in the presence of the platinum group metals having a content lower than the typical content in the conventional Ti-Pd alloys (about 0.2%), thereby improving the corrosion resistance of the resulting titanium alloy in non-oxidizing acids such as hydrochloric acid and sulfuric acid.

These effects of Co and Ni as alloying elements become appreciable when at least one of them is added in an amount of 0.1% or more along with the platinum group metal. Therefore, the minimum content of each of these elements is 0.1%. However, when the content of Co or Ni is over 2.0%, the amount of precipitated $Ti_2Co$ or $Ti_2Ni$ increases so much that the resulting alloy becomes too hard to maintain its ductility at a desirable level, thereby interfering with the manufacture and use of seamless tubes. Consequently, the maximum content of each of Co and Ni, which may be added either solely or in combination, is 2.0%. Preferably, one or both of Co and Ni are added in an amount of 0.2% to 1.2%. When alloyed with titanium, the effect of Co on improvement in crevice corrosion resistance is greater than that of a comparable amount in percent of Ni.

(iii) Oxygen (O)

A heat exchanger for gases is generally operated at a high pressure in order to improve the transport and production efficiency. Tubes applicable to such a heat exchanger must possess high strength and adequate deformability. Oxygen can be added to increase the strength of titanium due to its effect on solid solution hardening. However, when the oxygen content is over 0.35%, the deformability of the alloy is undesirably impaired from the standpoint of commercial use. Therefore, the maximum oxygen content is 0.35% and preferably 0.25%. In those applications where a high strength, such as a value for 0.2% proof stress of at least 35 $kgf/mm^2$, is required, it is preferred that the oxygen content be 0.15% or greater.

(iv) Iron (Fe)

Fe has an effect of improving the strength of titanium as well as its deformability under hot working. However, the presence of Fe in an excessively large amount adversely affects the corrosion resistance. In order to avoid such an adverse effect of Fe, the Fe content should be at most 0.30% and preferably at most 0.15%.

(v) Molybdenum (Mo), Tungsten (W), and Vanadium (V)

These alloying elements dissolve in a solution which the alloy contacts in use and form molybdate, tungstate, and vanadate ions, respectively, which have an oxidizing action and are effective to stabilize the passivated film formed on the surface of the titanium alloy, thereby improving the resistance to corrosion, particularly to crevice corrosion. Therefore, when it is greatly desired to improve the resistance to corrosion and particularly to crevice corrosion, one or more of Mo, W, and V may be added as optional alloying elements.

However, when the content of each of these elements is less than 0.1%, the corrosion resistance including crevice corrosion resistance cannot be improved appreciably. The addition of an excessively large amount of these elements adversely affects the deformability of the alloy. Therefore, the content of each of Mo, W, and V, when added, should be in the range of 0.1%-2.0% and preferably 0.5%-1.5%. When two or more of these elements are added, it is desirable that the total amount thereof be in the range of 0.1%-2.0%.

The balance of the titanium alloy used as a starting material in the present invention is essentially titanium (Ti), i.e., it consists of Ti and incidental impurities.

Seamless tubes are manufactured from the above-described titanium alloy starting material by subjecting it to one of the manufacturing processes (a) to (h) shown in the figure. In the following description, (a) to (h) and (1) to (15) refer to manufacturing processes and steps, respectively, illustrated in the figure.

Process (a)

Hot rolled seamless tubes are manufactured by the following Steps (1) and (2).

(1) Preparation of a Billet

A titanium alloy ingot is heated to a temperature range of from 650° C. to a temperature 100° C. above the beta-transus point and hot-worked to form a billet. It is preferred that at least 30% of the total deformation be performed at temperatures below the beta-transus point.

Since the quality of a billet largely influences the basic properties of the seamless tube product manufactured therefrom by extrusion, the billet should be prepared carefully. Specifically, it is important that the billet have a uniform quality and be free from both compositional defects, such as foreign matter and segregates, and structural defects of the billet such as voids, cracks, and laminations.

In order to eliminate compositional defects, the starting material should be controlled carefully during melting. The melting of the starting material can be performed in the same manner as for conventional titanium alloys, namely, in a vacuum or in an inert gas atmosphere by vacuum arc melting, electron beam melting, or plasma beam melting.

In order to eliminate structural defects, the ingot should be carefully processed to form a billet as described below. The preparation of a billet from an ingot can be performed by forging, rolling, or a combination of both. The main purposes of these procedures are to improve the microstructure of the material and to obtain the shape adapted for the subsequent fabrication step. Whether the working is performed by forging or rolling or by a combination of forging and rolling, the heating temperature prior to such working should not be higher than 100° C. above the beta-transus point. If the ingot is heated to a higher temperature, the oxide layer on the surface of a forged billet will grow and the material will be softened excessively to such a degree that the uniformity of deformation will be impaired and the surface roughness of the resulting billet will be undesirably increased. In this case, the rough surface must be removed by machining, leading to a decrease in yield. The minimum heating temperature is approximately 650° C. from the standpoint of deformability. Preferably the heating temperature is in the range of from 850° C. to a temperature 50° C. above the beta-transus point.

(2) Production of Seamless Tube by Hot Working

The billet prepared in the preceding step is subjected to a tube extrusion process under hot conditions to obtain a seamless tube. This step involves many associated processes such as removal of the oxide layer and flaws on the surface of the billet by machining, formation of a bore in the billet by machining or piercing, application of a glass lubricant, expanding in which the pre-formed bore in the billet is expanded, and finishing in which the extruded tube is straightened and its surface is finished. In these processes, the conditions for heating and tube extrusion of the billet and subsequent heat treatment conditions are important.

Prior to tube extrusion, the billet is heated to a temperature range of from 600° C. to a temperature 50° C. above the beta-transus point using a suitable heater such as an electric furnace, induction heater, or gas- or oil-fired furnace. An antioxidant may be applied to the billet prior to heating in order to suppress oxidation of titanium during heating. In this case, since the oxide layer formed by heating is minimized, the time required for the finishing stage of the product is reduced and the product yield is increased. When the billet is heated to a temperature higher than 50° C. above the beta-transus point, the thickness of the oxide layer which is formed increases, thereby degrading the deformability of the surface portion of the billet and hence the surface defects of the product will increase. Preferably the heating temperature is from 800° C. to a temperature 50° C. above the beta-transus point.

After the billet has been heated, a glass lubricant is applied to the outer and inner surfaces and the front end surface (on the side to be inserted into a press) and the billet is inserted into a horizontal extrusion press. The outer and inner diameters of the extruded tube are determined by the sizes of a die and a mandrel, respectively, mounted on the press. During the expanding process, a glass disc for lubricating purposes is placed at the entrance of the bore on the side on which the mandrel is inserted.

Although the lowest working temperature depends on the capacity of the extrusion press, tube extrusion can be performed successfully at a temperature of 600° C. or higher. Surface cracking may occur when the billet is subjected to shear deformation at a temperature lower than 600° C.

After the extrusion, the extruded tube is finished by removing the glass lubricant remaining on the surface of the tube by a mechanical or chemical means such as shot blasting, grinding, or pickling. The tube is then straightened to improve its straightness and cut to a predetermined length. The desired seamless tube product is then obtained by machining the inner and/or outer surface of the tube, if necessary. In Process (a) shown in the figure, the final product is the as-extruded tube which has been finished as above.

Process (b)

The seamless tube obtained by Process (a) is subjected, after cutting, to heat treatment for release of residual stress or recrystallization. Namely, the following annealing step (3) is performed on the tube.

(3) Annealing

The tube is annealed in a temperature range of 500° C.-850° C. The holding time depends on the size of the product but is generally about 5 minutes or longer. The recrystallized grains becomes fine when the annealing is performed at a temperature slightly higher than the recrystallization temperature for a short period or in the (alpha+beta) temperature range which is lower than the beta-transus point, and the resulting product has a fine grain microstructure. At a temperature below 500° C., recrystallization does not occur, while at a temperature above 850° C., coarse grains are formed, resulting in a decrease in deformability and mechanical properties. In order to allow recrystallization to proceed completely, it is preferred that the annealing temperature be in the range of 600° C.-750° C.

In Process (b), the final product is a hot-rolled seamless tube having a microstructure refined by the above-described heat treatment or annealing step (3).

Process (c)

Subsequent to Step (3), i.e., the annealing step in Process (b), the tube is subjected to cold drawing followed by annealing again. The mother tube treated by this process is the hot-extruded tube which has been cut to a predetermined length and annealed.

(4) Cold Drawing

Cold drawing reduces the outer diameter and wall thickness of the tube to desired dimensions.

The cold drawing can be performed by drawing without a plug or mandrel, drawing with a floating plug or mandrel (floating plug drawing), or drawing with a fixed plug or mandrel (fixed plug drawing). Drawing without a plug or mandrel is employed when it is desired to reduce the outer diameter of the tube. Floating plug drawing and fixed plug drawing are employed in order to adjust the wall thickness. Prior to cold drawing, the mother tube is treated with a suitable lubricant to facilitate working and prevent surface galling during drawing. It is preferred that the mother tube be heated in air for a short period to form a thin oxide layer on its surface before the lubricant is applied since such a surface improves the lubricative properties. During the cold drawing, the reduction in area for each pass is preferably controlled to 30% or less. When it is over 30%, undesirable galling may occur between the tool and the tube.

(5) Annealing

The cold-drawn tube is then annealed to relieve residual stress and cause recrystallization of grains. The annealing temperature is higher than the recrystallization temperature and it is determined by the degree of deformation applied by the cold drawing. Generally the same annealing conditions as described in Step (3) may be employed.

When it is desired that the fine surface appearance formed by the cold drawing remain on the surface of the product, the heat treatment (annealing) is preferably performed in a vacuum or in an inert gas atmosphere.

The cold drawing step (4) and annealing step (5) may be repeated one or more times, if necessary, in order to obtain a tube of the desired final size.

Process (d)

As in Process (c), the hot-extruded tube obtained after the annealing step (3) is used as a mother tube and it is subjected to cold or warm rolling followed by heat treatment.

(6) Cold or Warm Rolling

The rolling can be performed by pilger mill rolling in order to deform the hot-extruded mother tube into a seamless tube having a thinner wall. Pilger mill rolling may be carried out not only under cold conditions but also in warm conditions (in a temperature range of approximately 100° C.-500° C.). The degree of deformation by rolling is not restricted as long as rolling can be performed successfully. However, it is desirable that the value for Q which is calculated by the following equation be at least 0.7:

$$Q = \frac{\ln (t/T)}{\ln (d/D)}$$

where
t : wall thickness after rolling,
T : wall thickness before rolling,
d : outer diameter after rolling, and
D : outer diameter before rolling.
When the value for Q is less than 0.7, surface defects tend to generate during rolling.

(7) Annealing

After the cold or warm rolling, annealing is performed for release of residual stress and recrystallization under the same conditions as described in Steps (3) and (5). Also in this process, when it is desired that the fine surface appearance formed by the cold rolling will remain on the surface of the product, the heat treatment (annealing) is preferably performed in a vacuum or in an inert gas atmosphere.

Steps (6) and (7) may also be repeated one or more times, if necessary, to obtain a tube of the desired final size.

Process (e)

After the annealing step (7) in Process (d), the tube is subjected to cold drawing followed by heat treatment.

(8) Cold Drawing

The cold drawing may be performed under the same conditions as described in Step (4), thereby varying the dimensions of the product tube as desired.

(9) Annealing

The annealing may be performed under the same conditions as described in Step (3).

These steps may be performed repeatedly, if necessary.

Process (f)

The hot-extruded tube which has been cut to a predetermined length and machined is used as a mother tube without heat treatment (annealing), and it is subjected to rolling under cold or warm conditions followed by heat treatment. This process is particularly applicable to those cases where the degree of deformation applied by the hot extrusion step (2) is relatively low, since the annealing step (3) after this step can be eliminated in these cases without adversely affecting the properties of the product, thereby making the process simpler advantageously.

The rolling step (10) and annealing step (11) may be performed under the same conditions as described in Steps (6) and (7), respectively. Steps (10) and (11) may be repeated one or more times, if necessary.

Process (g)

After the annealing step (11) in Process (f), the tube is further subjected to cold drawing and heat treatment. The conditions for the cold drawing step (12) and annealing step (13) may be the same as described in the cold drawing step (8) and subsequent annealing step (9), respectively. Likewise these steps may be performed repeatedly.

Process (h)

The hot-extruded tube which has been cut to a predetermined length and machined is used as a mother tube without heat treatment, and it is subjected to cold drawing and heat treatment. The conditions for the cold drawing step (14) and annealing step (15) may be the same as described in the cold drawing step (4) and subsequent annealing step (5), respectively, in Process (c). These steps may be performed repeatedly, if necessary.

According to the process of the present invention, seamless tubes can be manufactured in a stable manner from a relatively inexpensive titanium alloy having good corrosion resistance and good mechanical properties without adversely affecting these properties. The seamless tubes manufactured by the process of the present invention can be applied to tubing and piping for various types of facilities and equipment which are used in severe corrosive environments, thereby increasing their durability and reliability.

The following examples are presented to describe the invention more fully. It should be understood, however, that the specific details set forth in the examples are merely illustrative and the present invention is not restricted to the examples.

EXAMPLE

Titanium alloy ingots each measuring 300 mm in diameter and 1000 mm in length and having a composition shown in Table 1 were prepared by vacuum arc remelting and were then processed by the following steps corresponding to one of the above-described Processes (a) to (h) to form seamless titanium alloy tubes.

(1) Preparation of Billet

Each titanium alloy ingot was heated to 950° C. for 3.5 hours in a gas-fired furnace and hot-rolled through passes of 6 continuous grooved rolling mills to form a bloom 178 mm in diameter. The surface of the bloom was then machined to reduce the diameter to 174 mm, and a bore 38 mm or 44 mm in diameter was formed by piercing so as to extend along the longitudinal axis, resulting in the formation of a billet for tube extrusion.

(2) Hot Tube Extrusion

After the billet was heated to 900° C. by induction heating, a glass lubricant was applied to the outer and inner surfaces of the billet and the billet was hot-extruded using a horizontal extrusion press to form an extruded tube having the dimensions shown in Table 2, Column (2).

After the tube extrusion, the outer and inner surfaces were machined so as to remove the glass lubricant and oxide scale layer to prepare for the subsequent steps.

Each seamless tube was prepared by one of the above-described processes (a) to (h). The conditions for each step of the processes employed in this example are summarized in Table 2along with the size of the tube after working.

The billet-making step (1) and extrusion step (2) were performed in the manner described above, while the other steps were carried out as follows.

Annealing in Steps (3), (5), (7), (9), (11), (13), and (15)

After the mother tube was cleaned so as to remove oils and greases deposited on its surface by the preceding step, it was heated for 30 minutes at 650° C. in a vacuum furnace and cooled in the furnace.

Cold Drawing in Steps (4), (8), (12), and (14)

The cold drawing was performed by the floating plug drawing method.

Rolling in Steps (6) and (10)

After a rolling mill oil was applied to the surface of the mother tube, the mother tube was rolled at room temperature through a pilger mill.

The resulting seamless tubes were evaluated with respect to metallographical texture, surface properties, corrosion resistance, and mechanical properties by the following testing methods.

a. Metallographical Test

A radial cross section of the tube was observed to examine the microstructure.

b. Surface Observation

The surface of the tube was observed visually and the presence or absence of defects were examined by microscopic observation of a cross section and by a penetration test.

c. Tensile Test

A tensile test was performed on a 350 mm-long tube-shaped test piece. The gage length of the test piece was 50 mm. The strain rate was 0.5% per minute until a 0.2% proof stress was applied, and was 20% per minute between the 0.2% proof stress and breaking.

d. Crevice Corrosion Test

A pair of test pieces for crevice corrosion taken from the tube were separated by polytetrafluoroethylene (PTFE) spacers to form a crevice between the pieces and were secured together by titanium bolts. The crevice corrosion test was performed using a salt solution containing 250 g/l of NaCl and a sufficient amount of HCl to adjust the pH of the solution to 2. The test pieces were immersed in the salt solution for 500 hours at 200° C.

After the test, the surface of the crevice was observed visually and the occurrence of crevice corrosion was determined by the presence of a corrosion product ($TiO_2$).

e. Corrosion Resistance Test in Hydrochloric Acid

Test pieces similar to those used for crevice corrosion taken from the tube were immersed in a boiling 3% hydrochloric acid solution for 200 hours and the resistance to hydrochloric acid was evaluated in terms of depth of corrosion (in mm per year).

The test results are also included in Table 1.

TABLE 1

| No. | Chemical Composition (wt % Ti:bal.) Pd | Ru | Other Platinum group metal | Co | Ni | Mo | W | V | O | Fe | Resistance to crevice corrosion | Corrosion rate (mm/year) | 0.2% proof stress (kgf/mm²) | Tensile strength (kgf/mm²) | Elongation (%) | Overall evaluation | Manufacturing process of the figure employed |
|---|---|---|---|---|---|---|---|---|---|---|---|---|---|---|---|---|---|
| 1* | 0.02 | | | | | | | | 0.05 | 0.04 | Δ | 0.50 | 19.0 | 32.5 | 51 | x (A) | (a) |
| 2 | 0.02 | | | 0.5 | | | | | 0.05 | 0.05 | ○ | 0.10 | 25.2 | 35.7 | 50 | ○ | (b) |
| 3 | 0.05 | | | 0.3 | | | | | 0.05 | 0.04 | ○ | 0.04 | 22.1 | 33.3 | 48 | ○ | (f) |
| 4 | 0.12 | | | 0.3 | | | | | 0.04 | 0.04 | ○ | 0.01 | 20.9 | 31.7 | 49 | ○ | (c) |
| 5 | 0.06 | | | 1.8 | | | | | 0.04 | 0.04 | ○ | 0.02 | 41.9 | 47.5 | 35 | ○ | (d) |
| 6 | 0.05 | | | | 0.5 | | | | 0.05 | 0.04 | ○ | 0.12 | 24.9 | 35.4 | 48 | ○ | (f) |
| 7 | 0.10 | | | | 0.3 | | | | 0.05 | 0.04 | ○ | 0.07 | 22.1 | 33.3 | 47 | ○ | (g) |
| 8 | 0.03 | | | | 1.7 | | | | 0.04 | 0.04 | ○ | 0.11 | 40.5 | 46.4 | 38 | ○ | (b) |
| 9 | 0.05 | | | | | 0.8 | | | 0.05 | 0.04 | ○ | 0.06 | 45.9 | 55.3 | 28 | ○ | (e) |
| 10 | 0.06 | | | | | | 0.6 | | 0.04 | 0.04 | ○ | 0.06 | 37.7 | 47.5 | 29 | ○ | (c) |
| 11 | 0.05 | | | | | | | 1.2 | 0.05 | 0.04 | ○ | 0.06 | 59.9 | 67.9 | 22 | ○ | (g) |
| 12 | 0.05 | | | 0.3 | 0.3 | | | | 0.04 | 0.04 | ○ | 0.03 | 25.1 | 34.9 | 45 | ○ | (f) |
| 13 | 0.05 | | | 0.3 | | 0.5 | | | 0.04 | 0.04 | ○ | 0.03 | 38.4 | 47.5 | 46 | ○ | (d) |
| 14 | 0.05 | | | 0.4 | | | 0.3 | | 0.05 | 0.05 | ○ | 0.03 | 34.3 | 44.1 | 47 | ○ | (e) |
| 15 | 0.05 | | | 0.3 | | | | 0.7 | 0.04 | 0.05 | ○ | 0.03 | 45.8 | 54.1 | 28 | ○ | (e) |
| 16 | 0.10 | | | 0.3 | 0.2 | | | | 0.05 | 0.04 | ○ | 0.01 | 24.9 | 35.9 | 48 | ○ | (h) |
| 17 | 0.10 | | | 0.3 | | 0.5 | | | 0.05 | 0.04 | ○ | 0.01 | 39.6 | 49.0 | 35 | ○ | (d) |
| 18 | 0.10 | | | 0.3 | | | 0.4 | | 0.04 | 0.04 | ○ | 0.01 | 34.9 | 44.3 | 33 | ○ | (f) |
| 19 | 0.10 | | | 0.3 | | | | 0.5 | 0.04 | 0.05 | ○ | 0.01 | 39.6 | 49.0 | 31 | ○ | (d) |
| 20* | | 0.03 | | | | | | | 0.04 | 0.05 | Δ | 0.55 | 17.9 | 30.1 | 50 | x (A) | (b) |
| 21 | | 0.02 | | 0.5 | | | | | 0.04 | 0.05 | ○ | 0.15 | 24.9 | 35.4 | 52 | ○ | (d) |
| 22 | | 0.05 | | 0.5 | | | | | 0.03 | 0.05 | ○ | 0.04 | 24.6 | 35.6 | 51 | ○ | (h) |
| 23 | | 0.05 | | 1.1 | | | | | 0.03 | 0.04 | ○ | 0.03 | 33.3 | 41.7 | 47 | ○ | (d) |
| 24 | | 0.05 | | | 0.5 | | | | 0.05 | 0.04 | ○ | 0.06 | 24.8 | 35.7 | 50 | ○ | (f) |
| 25 | | 0.11 | | 0.5 | | | | | 0.04 | 0.05 | ○ | 0.02 | 24.6 | 35.2 | 51 | ○ | (d) |
| 26 | | 0.05 | | 0.3 | 0.3 | | | | 0.04 | 0.05 | ○ | 0.04 | 26.3 | 36.3 | 52 | ○ | (d) |
| 27 | | 0.05 | | 0.4 | | 0.5 | | | 0.04 | 0.04 | ○ | 0.04 | 41.0 | 49.7 | 39 | ○ | (a) |
| 28 | | 0.05 | | 0.4 | | | 0.4 | | 0.05 | 0.05 | ○ | 0.04 | 37.4 | 46.7 | 37 | ○ | (c) |
| 29 | | 0.05 | | 0.4 | | | | 0.6 | 0.03 | 0.05 | ○ | 0.04 | 44.4 | 53.1 | 29 | ○ | (f) |
| 30 | | 0.05 | | 1.1 | | | 1.0 | | 0.04 | 0.05 | ○ | 0.02 | 68.3 | 73.2 | 19 | ○ | (a) |
| 31 | | 0.05 | | | 1.0 | | 1.0 | | 0.04 | 0.04 | ○ | 0.02 | 66.9 | 72.1 | 20 | ○ | (a) |
| 32 | | 0.05 | | 1.0 | 0.2 | 0.9 | | | 0.05 | 0.05 | ○ | 0.02 | 66.2 | 71.1 | 20 | ○ | (d) |
| 33 | | | Ir 0.05 | 0.4 | | | | | 0.05 | 0.04 | ○ | 0.05 | 23.6 | 34.3 | 49 | ○ | (c) |
| 34 | | | Os 0.05 | 0.4 | | | | | 0.05 | 0.05 | ○ | 0.05 | 23.3 | 34.5 | 48 | ○ | (g) |
| 35 | | | Pt 0.05 | 0.3 | | | | | 0.05 | 0.05 | ○ | 0.05 | 22.1 | 33.0 | 49 | ○ | (f) |
| 36* | | | | 0.3 | | | | | 0.05 | 0.05 | x | 0.05 | 21.9 | 33.3 | 49 | x (A) | (c) |
| 37 | 0.03 | 0.03 | | 0.4 | | | | | 0.05 | 0.05 | ○ | 0.01 | 23.3 | 34.6 | 48 | ○ | (h) |
| 38 | 0.07 | 0.04 | | 0.4 | | | | | 0.05 | 0.04 | ○ | 0.01 | 23.4 | 34.1 | 48 | ○ | (e) |
| 39 | 0.03 | 0.07 | | 0.3 | | | | | 0.04 | 0.04 | ○ | 0.01 | 22.2 | 33.4 | 49 | ○ | (e) |
| 40 | | | Ir 0.02, Os 0.03, Pt 0.05 | 0.3 | | | | | 0.04 | 0.05 | ○ | 0.02 | 25.5 | 35.0 | 47 | ○ | (e) |
| 41 | 0.05 | | | 0.3 | | | | | 0.19 | 0.05 | ○ | 0.04 | 37.0 | 53.6 | 19 | ○ | (f) |
| 42 | 0.05 | | | 0.3 | | | | | 0.25 | 0.30 | ○ | 0.06 | 52.9 | 71.6 | 19 | ○ | (d) |
| 43 | 0.05 | | | | 0.5 | | | | 0.21 | 0.05 | ○ | 0.04 | 43.2 | 60.3 | 20 | ○ | (d) |
| 44 | 0.05 | | | 0.3 | 0.3 | | | | 0.22 | 0.10 | ○ | 0.02 | 47.4 | 64.5 | 20 | ○ | (e) |
| 45 | 0.05 | | | 0.3 | | | 0.3 | | 0.25 | 0.25 | ○ | 0.03 | 62.3 | 80.1 | 18 | ○ | (e) |
| 46 | 0.05 | | | | 0.3 | 0.4 | | | 0.25 | 0.25 | ○ | 0.03 | 65.8 | 83.3 | 18 | ○ | (c) |
| 47 | 0.05 | | | 0.3 | 0.3 | | 0.3 | | 0.25 | 0.25 | ○ | 0.02 | 66.5 | 83.2 | 18 | ○ | (b) |
| 48 | 0.02 | 0.02 | | 0.3 | | | | | 0.22 | 0.05 | ○ | 0.02 | 41.4 | 59.7 | 21 | ○ | (b) |
| 49 | 0.02 | 0.03 | | | 0.4 | | | | 0.20 | 0.05 | ○ | 0.02 | 40.6 | 57.7 | 22 | ○ | (b) |
| 50 | | 0.05 | | 0.3 | | | | | 0.20 | 0.05 | ○ | 0.04 | 39.2 | 56.7 | 22 | ○ | (a) |

TABLE 1-continued

| No. | Chemical Composition (wt.%, Ti bal.) Pd | Ru | Other Platinum group metal | Co | Ni | Mo | W | V | O | Fe | Resistance to crevice corrosion | Corrosion rate (mm/year) | 0.2% proof stress (kgf/mm²) | Tensile strength (kgf/mm²) | Elongation (%) | Overall evaluation | Manufacturing process of the figure employed |
|---|---|---|---|---|---|---|---|---|---|---|---|---|---|---|---|---|---|
| 51 | | 0.05 | | | 0.5 | | | | 0.20 | 0.05 | ( ) | 0.04 | 42.0 | 58.8 | 21 | ( ) | (f) |
| 52 | | 0.05 | | 0.3 | 0.3 | | | | 0.18 | 0.05 | ( ) | 0.02 | 41.2 | 56.6 | 21 | ( ) | (f) |
| 53 | | 0.05 | | 0.3 | | | 0.8 | | 0.18 | 0.05 | ( ) | 0.02 | 47.5 | 63.2 | 20 | ( ) | (g) |
| 54 | | 0.05 | | | 0.3 | | 0.8 | | 0.18 | 0.05 | ( ) | 0.03 | 47.2 | 62.8 | 20 | ( ) | (a) |
| 55* | | | | | | | | | 0.10 | 0.06 | x | 7.52 | 30.2 | 43.2 | 32 | x (A) | (b) |
| 56* | | | | | 0.8 | 0.3 | | | 0.14 | 0.09 | Δ | 3.50 | 42.0 | 61.3 | 26 | x (A) | (d) |
| 57* | 0.20 | | | | | | | | 0.10 | 0.06 | ( ) | 0.01 | 31.1 | 42.8 | 34 | x (B) | (e) |
| 58* | 0.05 | | | 0.3 | | | | | 0.40 | 0.10 | ( ) | 0.05 | 62.1 | 80.1 | 8 | x (C) | (b) |
| 59* | 0.05 | | | 0.3 | | | | | 0.15 | 0.45 | ( ) | 0.51 | 58.1 | 75.0 | 7 | x (C) | (e) |
| 60* | 0.05 | | | 2.5 | | | | | 0.25 | 0.25 | ( ) | 0.02 | 62.1 | 85.1 | 5 | x (C) | (f) |
| 61* | | 0.05 | | | 2.5 | | | | 0.25 | 0.25 | ( ) | 0.02 | 67.2 | 88.3 | 6 | x (C) | (a) |
| 62* | 0.20 | | | 0.3 | | | | | 0.05 | 0.05 | ( ) | 0.01 | 20.1 | 32.6 | 53 | x (B) | (e) |

(Notes)

*Comparative runs in which the alloy composition is outside the range defined herein Resistance to crevice corrosion: ( ) no crevice corrosion occurred, Δ slight crevice corrosion occurred, x severe crevice corrosion occurred Overall evaluation: (A) Poor corrosion resistance, (B) High material costs, (C) Poor elongation

TABLE 2

| Process | 1 Billet making Heating to 950° C | 2 Hot extrusion Heating to 900° C | 3 Annealing | 4 Cold drawing | 5 Annealing | 6 Rolling | 7 Annealing | 8 Cold drawing |
|---|---|---|---|---|---|---|---|---|
| (a) | 174 ϕ<br>38 ϕi | 75 ϕ<br>10 t | — | — | — | — | — | — |
| (b) | 174 ϕ<br>38 ϕi | 75 ϕ<br>10 t | 650° C.<br>30 min | — | — | — | — | — |
| (c) | 174 ϕ<br>38 ϕi | 64 ϕ<br>10 t | 650° C.<br>30 min | 60 ϕ<br>7 t | 650° C.<br>30 min | — | — | — |
| (d) | 174 ϕ<br>44 ϕi | 64 ϕ<br>12 t | 650° C.<br>30 min | — | — | 27 ϕ<br>3.5 t | 650° C.<br>30 min | |
| (e) | 174 ϕ<br>44 ϕi | 64 ϕ<br>12 t | 650° C.<br>30 min | — | — | 27 ϕ<br>3.5 t | 650° C.<br>30 min | 25.4 ϕ<br>3.0 t |
| (f) | 174 ϕ<br>44 ϕi | 64 ϕ<br>12 t | — | — | — | — | — | — |
| (g) | 174 ϕ<br>44 ϕi | 64 ϕ<br>12 t | — | — | — | — | — | — |
| (h) | 174 ϕ<br>44 ϕi | 64 ϕ<br>10 t | — | — | — | — | — | — |

| Process | 9 Annealing | 10 Rolling | 11 Annealing | 12 Cold drawing | 13 Annealing | 14 Cold drawing | 15 Annealing | Final product |
|---|---|---|---|---|---|---|---|---|
| (a) | — | — | — | — | — | — | — | 73 ϕ<br>8 t |
| (b) | — | — | — | — | — | — | — | 73 ϕ<br>8 t |
| (c) | — | — | — | — | — | — | — | 60 ϕ<br>7 t |
| (d) | — | — | — | — | — | — | — | 27 ϕ<br>3.5 t |
| (e) | 650° C.<br>30 min | — | — | — | — | — | — | 25.4 ϕ<br>3 t |
| (f) | — | 27 ϕ<br>3.5 t | 650° C.<br>30 min | — | — | — | — | 27 ϕ<br>3.5 t |
| (g) | — | 27 ϕ<br>3.5 t | 650° C.<br>30 min | 25.4 ϕ<br>3.0 t | 650° C.<br>30 min | — | — | 25.4 ϕ<br>3 t |
| (h) | — | — | — | — | — | 60 ϕ<br>7 t | 650° C.<br>30 min | 60 ϕ<br>7 t |

(Note) ϕ: outer diameter (mm), ϕi: inner diameter (mm), t: wall thickness (mm)

As is apparent from the results shown in Table 1, the titanium alloys used in the present invention which contain a relatively small amount of the platinum group metals in combination with Co and/or Ni and optionally one or more of Mo, W, and V exhibit excellent crevice corrosion resistance comparable to that of the conventional, expensive Ti-0.2Pd alloy.

Titanium alloys to which only Pd or Ru is added do not have satisfactory crevice corrosion resistance when the content of Pd or Ru is 0.02% (Run Nos. 1 and 20). However, the addition of 0.5% Co to such alloys significantly improves the crevice corrosion resistance (Run Nos. 2 and 21). Similarly, the addition of Ni, or Co and Ni, or one or both of Co and Ni along with one or more of Mo, W, and V to a titanium alloy containing a small amount of Pd, Ru, or other platinum group metal results in a significant improvement in corrosion resistance including crevice corrosion resistance and provides a titanium alloy having corrosion resistance which is far superior to that of pure titanium (Run No. 55) or a titanium alloy of ASTM Grade 12(Run No. 56).

When oxygen and/or Fe is added for improving the strength, the corrosion resistance of the resulting alloys is not degraded and their ductility remains at a satisfactory level as long as the oxygen content is not more than 0.35% (Run Nos. 41-54). In contrast, a titanium alloy containing more than 0.35% oxygen has a decreased ductility (Run No. 58) while that containing more than 0.3% Fe has decreased elongation and resistance to acids (Run No. 59).

The ductility of titanium alloys containing Co or Ni in an excessively large amount is decreased to such a degree that they are no longer useful for practical applications (Run Nos. 60 and 61).

The seamless tubes shown in Table 1 were produced by one of the processes shown in Table 2 which all satisfy the conditions of the present invention. All the processes employed in the example proceeded smoothly and resulted in the production of seamless tubes which were free from surface defects and which had a texture of completely recrystallized grains.

For comparison, seamless tubes were produced under the following conditions which did not satisfy those defined herein. The starting material used in this comparative test was a billet 175 mm in diameter and 500 mm in length of a titanium alloy having a composition of Ti-0.05 Pd-0.3 Co-0.20 oxygen-0.08 Fe.

(1) Billet Making Under Improper Conditions

When the billet was prepared by forging after being heated to 1100° C., the resulting surface oxide layer had an uneven thickness and the surface of the billet had to be machined about 5 times as much as the billet in the example of the present invention in order to obtain a smooth surface suitable for the subsequent step.

On the other hand, when the heating temperature was 600° C. prior to forging, the resistance to deformation of the material was high and the forged billet had many surface cracks due to a low deformability.

(2) Hot Tube Extrusion Under Improper Conditions

The billet was extruded after being heated to 1100° C. or 550° C. The tube which was extruded after heating to 1100° C. had a rough surface, while that extruded after heating to 550° C. had surface cracks due to an insufficient deformability.

(3) Annealing Under Improper Conditions

Seamless tubes obtained by hot extrusion and having an outer diameter of 27 mm and a wall thickness of 1.5 mm were subjected to heat treatment for 30 minutes at temperatures in the range of 450° C.-900° C. and the changes in microstructure and residual stress were examined.

Heat treatment at 900° C. formed transformed phases (beta-phases), resulting in a decrease in ductility. When the heat treatment was performed at 350° C., 400° C., or 450° C., recrystallization did not occur completely and the resulting material had a ductility lower than a completely recrystallized material.

Also in the case of final annealing which was performed subsequent to working (drawing or rolling) in Processes (c) to (h), satisfactory mechanical properties could be obtained as long as the heating temperature was in the range of 500° C.-850° C. At a temperature of 900° C., beta-phases were formed by the heat treatment. Heat treatment at 450° C., the ductility of the resulting tube was not sufficient due to incomplete recrystallization.

Although the invention has been described with respect to preferred embodiments, it is to be understood that variations and modifications may be employed without departing from the concept of the invention as defined in the following claims.

What is claimed is:

1. A process for manufacturing a seamless titanium alloy tube or pipe having good resistance to crevice corrosion from a titanium alloy which consists essentially, by weight, of one or more of the platinum group metals in a total amount of 0.01-0.14%, at least one of Ni and Co each in an amount of 0.1%-2.0%, not more than 0.35% of oxygen, not more than 0.30% of iron, optionally at least one of Mo, W, and V each in an amount of 0.1%-2.0%, and a balance of Ti, the process comprising the steps of:

(a) preparing a billet by hot working from an ingot of the titanium alloy after the ingot has been heated in a temperature range of from 650° C. to a temperature 100° C. above the beta-transus point; and (b) subjecting the billet to tube extrusion using a glass lubricant to form a seamless tube or pipe after the billet has been heated in a temperature range of from 650° C. to a temperature 100° C. above the beta-transus point.

2. The process of claim 1 which further comprises the step of:

(c) annealing the tube or pipe obtained in step (b) in a temperature range of 500° C.-850° C.

3. The process of claim 1 which further comprises the steps of:

(c) subjecting the extruded tube or pipe obtained in step (b) to rolling under cold or warm conditions; and (d) annealing the tube or pipe in a temperature range of 500° C.-850° C.

4. The process of claim 1 which further comprises the steps of:

(c) subjecting the extruded tube or pipe obtained in step (b) to drawing under cold conditions; and (d) annealing the tube or pipe in a temperature range of 500° C.-850° C.

5. The process of claim 1 wherein the titanium alloy consists essentially, by weight, of one or more of the platinum group metals in a total amount of 0.03%-0.10%, at least one of Ni and Co each in an amount of 0.2%-1.2%, not more than 0.25% of oxygen, not more than 0.15% of iron, optionally at least one of Mo, W, and V each in an amount of 0.5%-1.5%, and a balance of Ti.

6. The process of claim 1 wherein the ingot is heated in a temperature range of from 850° C. to a temperature 50° C. above the beta-transus point before hot working.

7. The process of claim 1 wherein the billet is heated in a temperature range of from 800° C. to a temperature 50° C. above the beta-transus point before tube extrusion.

8. The process of claim 2 which further comprises the steps of:

(d) subjecting the annealed tube or pipe obtained in step (c) to drawing under cold conditions; and (e) annealing the tube or pipe in a temperature range of 500° C.-850° C.

9. The process of claim 2 which further comprises the steps of:

(d) subjecting the annealed tube or pipe obtained in step (3) to rolling under cold or warm conditions; and (e) annealing the tube or pipe in a temperature range of 500° C.-850° C.

10. The process of claim 2 wherein the annealing step (c) is performed in a temperature range of 600° C.-750° C.

11. The process of claim 3 wherein steps (c) and (d) are performed repeatedly.

12. The process of claim 3 which further comprises the steps of:

(e) subjecting the annealed tube or pipe obtained in step (d) to drawing under cold conditions; and (f) annealing the tube or pipe in a temperature range of 500° C.-850° C.

13. The process of claim 4 wherein steps (c) and (d) are performed repeatedly.

14. The process of claim 8 wherein steps (d) and (e) are performed repeatedly.

15. The process of claim 9 wherein steps (d) and (e) are performed repeatedly.

16. The process of claim 9 which further comprises the steps of:

(f) subjecting the tube or pipe obtained in step (e) to drawing under cold conditions; and (g) annealing the tube or pipe in a temperature range of 500° C.-850° C.

17. The process of claim 12 wherein steps (e) and (f) are performed repeatedly.

18. The process of claim 16 wherein steps (f) and (g) are performed repeatedly.

* * * * *